US006176468B1

(12) United States Patent
Boulanger

(10) Patent No.: US 6,176,468 B1
(45) Date of Patent: Jan. 23, 2001

(54) SAFETY LOCKING MECHANISM FOR A MECHANICAL LIFTING JACK

(75) Inventor: David M. Boulanger, Kitchener (CA)

(73) Assignee: Northman Holdings Inc., Kitchener (CA)

( * ) Notice: Under 35 U.S.C. 154(b), the term of this patent shall be extended for 0 days.

(21) Appl. No.: 09/292,830

(22) Filed: Apr. 16, 1999

(51) Int. Cl.[7] ..... B66F 1/04
(52) U.S. Cl. ..... 254/108; 254/111; 254/DIG. 3
(58) Field of Search ..... 254/108, 106, 254/111, DIG. 3, 105

(56) References Cited

U.S. PATENT DOCUMENTS

| | | | |
|---|---|---|---|
| 176,900 | 2/1876 | Thurston | 254/108 |
| 2,515,744 | 5/1950 | Stuck et al. | 254/108 |
| 3,606,246 | 9/1971 | Harrah | 254/108 |
| 3,848,851 | 11/1974 | Elias | 254/108 |
| 4,568,064 | 2/1986 | Reinhardt | 254/111 |

*Primary Examiner*—David A. Scherbel
*Assistant Examiner*—Lee Wilson
(74) *Attorney, Agent, or Firm*—Dimock Stratton Clarizio; Mark B. Eisen

(57) ABSTRACT

A mechanical lifting jack with a locking mechanism that arrests upward motion of the handle if the handle is suddenly released by the operator while raising or lowering a load. A latch on the pivot attachment of the handle to the lifting assembly is actuated by a lever disposed at the distal end of the handle, and engages into a toothed safety link when the lever is released. In the event that the operator suddenly releases the handle accidentally, the latch engages the safety link to arrest the upward motion of the handle. The invention can also be used to lock the handle into an upright position alongside the vertical support for compact storage.

14 Claims, 3 Drawing Sheets

SAFETY LOCKING MECHANISM FOR A MECHANICAL LIFTING JACK

FIELD OF INVENTION

This invention relates to mechanical lifting jacks. In particular, this invention relates to a mechanical lifting jack with a safety mechanism that prevents the handle from recoiling violently when accidentally released by the operator.

BACKGROUND OF THE INVENTION

Mechanical jacks are widely used to lift heavy loads, usually up to 8,000 lbs. (3,620 kg). A typical mechanical jack comprises a vertical support slidably supporting an upper lifting assembly and a lower follower assembly, the lifting and follower assemblies being engagable to the support at a series of predetermined latching positions along its length. An operating handle has one end pivotally connected to the lifting assembly and a link pivotally connected between the handle and the follower assembly. The lifting assembly includes a reversing member which is set in one position for lifting a load and in another position for lowering a load.

With the reversing member set to the lifting position, a load can be raised by reciprocation of the handle, which in the down-stroke moves the lifting assembly to the next higher latching position and in the up-stroke moves the follower assembly to the next higher latching position. With the reversing member set to the lowering position, the load can be lowered by controlled resistance applied to the handle as the load forces the handle upwardly, the lifting assembly latching into the next lower latching position as the handle nears the top of its stroke. An example of such a jack is described and illustrated in U.S. Pat. No. 4,568,064 issued Feb. 4, 1986 to Reinhardt, which is incorporated herein by reference.

Mechanical lifting jacks can be extremely dangerous if used improperly. When lowering a load the upward force on the handle can be sufficient to cause the operator to lose his or her grip. If the operator's hands slip off of the handle before the lifting assembly has latched into the next lower latching position on the vertical support, the handle can swing upward violently with the potential to cause serious injury to the operator.

The present invention overcomes this problem by providing a mechanical lifting jack with a locking mechanism that arrests upward motion of the handle if the handle is suddenly released by the operator while lowering a load. The invention accomplishes this by providing a latch on the pivot attachment of the handle to the lifting assembly, actuated by a lever disposed at the distal end of the handle, and a toothed safety link into which the latch engages whenever the lever is released.

Thus, in the event that the operator suddenly releases the handle accidentally before the lifting mechanism has locked into the next lower latching position on the vertical support, the latch engages the safety link to arrest the upward motion of the handle. The invention can also be used to lock the handle into an upright position alongside the vertical support, for compact storage.

The present invention thus provides a mechanical lifting jack having a vertical support provided with a series of apertures, an upper lifting assembly and a lower follower assembly having a lifting foot slidably mounted on the vertical support and engagable therewith at predetermined positions, an operating handle pivotally connected by a yoke to the lifting assembly for vertical movement, a safety link pivotally connected at an upper end to the handle and at a lower end to the follower assembly, and a reversing member pivotable between a lifting position for lifting the load by reciprocal movement of the handle causing upward movement alternately of the lifting and lowering assemblies and a lowering position for lowering the load by reciprocal movement of the handle causing downward movement alternately of the lifting and lowering assemblies, a latching member extending between opposed arms of the yoke, movable between a latching position and a retracted position and biased to the latching position, a lever projecting from the handle operatively connected to the latching member, to move the latching member between the latching position and the retracted position, and a rotationally fixed toothed element extending into a space between the arms of the yoke, whereby when the latching member is engaged into the toothed element the handle is prevented from substantial upward or downward movement and depression of the lever retracts the latching member from the toothed element and allows the handle to move through its normal operating motion.

The present invention further provides a safety latch for a mechanical lifting jack having a vertical support provided with a series of apertures, an upper lifting assembly and a lower follower assembly having a lifting foot slidably mounted on the vertical support and engagable therewith at predetermined positions, an operating handle pivotally connected by a yoke to the lifting assembly for vertical movement, a safety link pivotally connected at an upper end to the handle and at a lower end to the follower assembly, and a reversing member pivotable between a lifting position for lifting the load by reciprocal movement of the handle causing upward movement alternately of the lifting and lowering assemblies and a lowering position for lowering the load by reciprocal movement of the handle causing downward movement alternately of the lifting and lowering assemblies, the safety latch comprising a latching member extending between opposed arms of the yoke, movable between a latching position and a retracted position and biased to the latching position, a lever projecting from the handle operatively connected to the latching member, to move the latching member between the latching position and the retracted position, and a rotationally fixed toothed element extending into a space between the arms of the yoke, whereby when the latching member is engaged into the toothed element the handle is prevented from substantial upward or downward movement and depression of the lever retracts the latching member from the toothed element and allows the handle to move through its normal operating motion.

BRIEF DESCRIPTION OF THE DRAWINGS

In drawings which illustrate by way of example only a preferred embodiment of the invention.

DETAILED DESCRIPTION OF THE INVENTION

Figure 1:
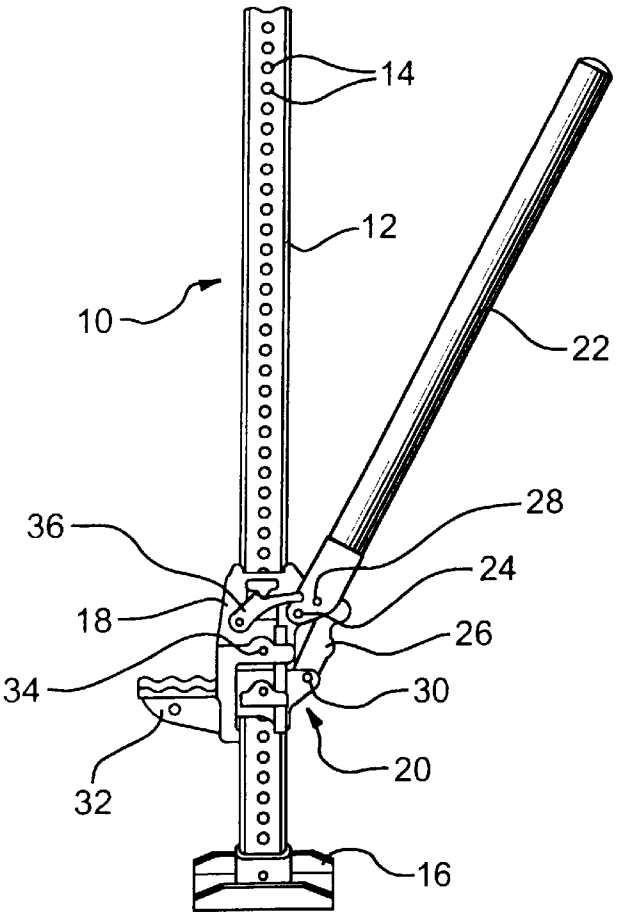
FIG.1 PRIOR ART
FIG. 1 is a perspective view of a prior art mechanical lifting jack.

FIG. 1 illustrates a prior art mechanical lifting jack 10. A vertical support 12 with an I-beam cross-section is provided with a series of evenly spaced apertures 14 and mounted on a base plate 16. An upper lifting assembly 18 and lower follower assembly 20 of conventional design are slidably mounted on the support 12. An operating handle 22 is pivotally connected to the lifting assembly 18 at a pin 24, and a pitman or link 26 is pivotally connected at one end to the handle 22 by a pin 28 and at the other end to the follower assembly 20 by a pin 30. As is well known, the follower assembly 20 has a lifting foot 32 for engaging underneath the load (not shown) and a pin 34 biased toward the apertures 14 for engaging the next nearest aperture 14 when the lift 10 is lifting or lowering a load. A reversing member 36 mounted on the lifting assembly 18 is pivotable between a lower position, as shown in FIG. 1, for lifting the load and an upper position for lowering the load. The mechanical jack described thus far is described in U.S. Pat. No. 4,568,064 and is well known to those skilled in the art.

Figure 2:
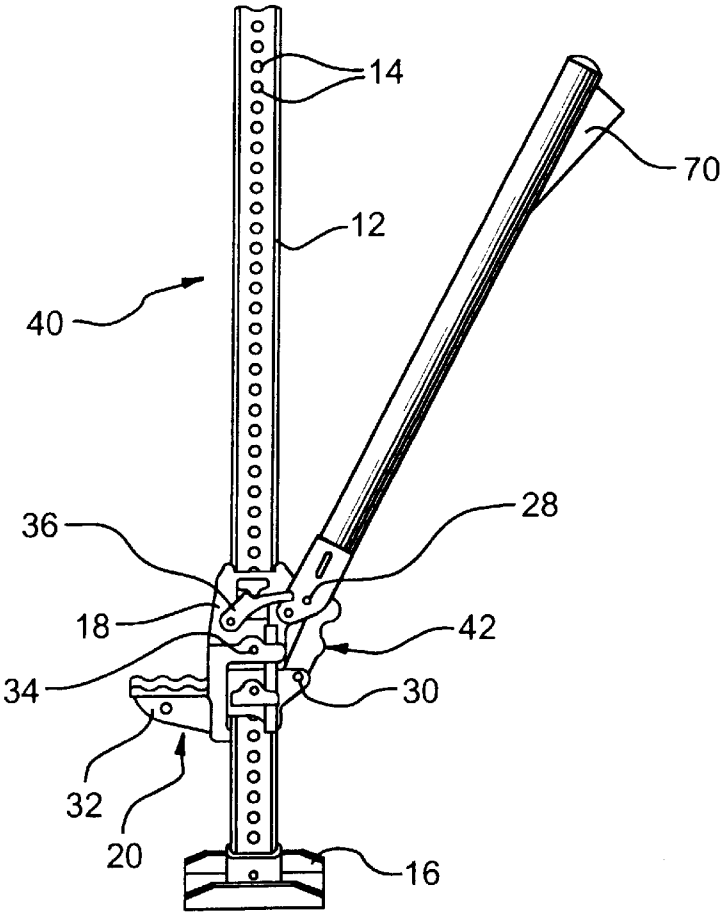
FIG. 2 is a perspective view of a mechanical lifting jack according to the invention.
Figure 4:
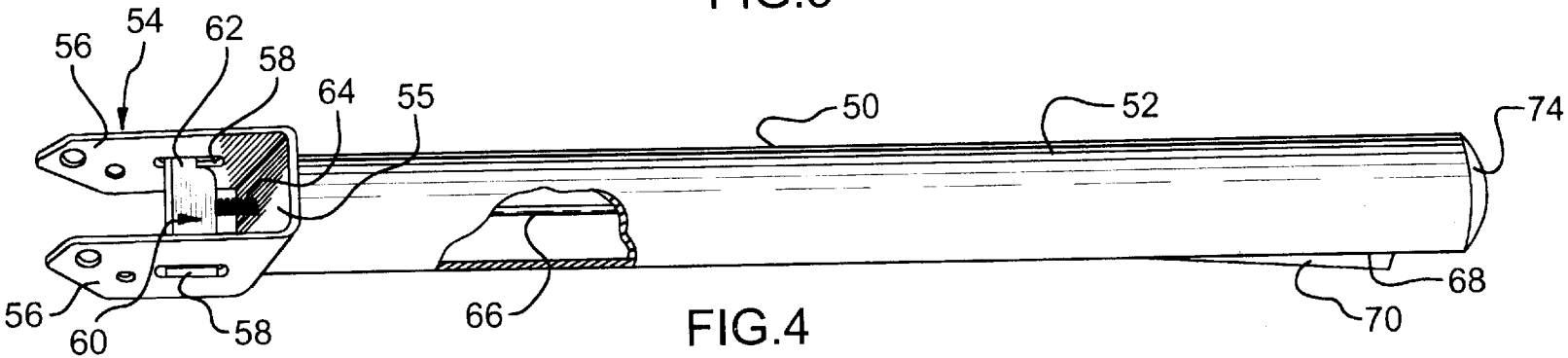
FIG. 4 is a perspective view of the safety latching mechanism in the jack of FIG. 2.

FIG. 2 illustrates a mechanical lifting jack 40 according to the invention. The operating handle 50, illustrated in FIGS. 4 and 7, comprises a hollow tubular member 52 strong enough to bear the force on the handle 50 when lifting and lowering heavy loads. The end of the handle 50 which is affixed to the follower assembly 20 has a yoke 54 with arms 56 having slots 58 disposed in the direction of the handle 50. A latching member 60 having end wings 62 is trapped in the slots 58 and able to slide between a retracted position, shown in phantom in FIG. 7, and a latching position, shown in solid lines in FIG. 7. The latching member 60 is biased toward the latching position by a compression spring 64 engaged over an actuating rod 66 and applying a force between the base 55 of the yoke 54 and the latching member 60.

The actuating rod 66 extends through the base 55 of the yoke 54 and through the hollow tubular member 52, and engages a lever 70 which protrudes through a slot 68 in the tubular member 52 near the distal end of the handle 50 (i.e. the end of the handle 50 remote from the pivotal connection with the follower assembly 20).

Figure 6:
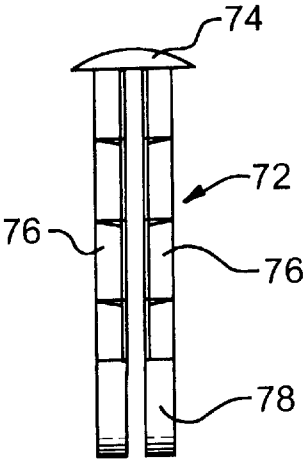
FIG. 6 is a front elevation of the handle insert.
Figure 5:
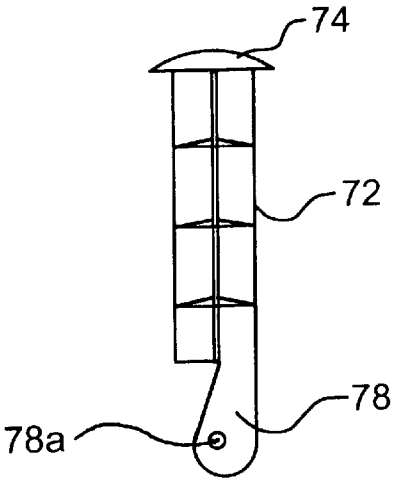
FIG. 5 is a side elevation of a handle insert for securing the lever.

In the preferred embodiment the distal end of the tubular member 52 is closed by a handle insert 72, illustrated in FIGS. 5 and 6, having a cap 74 and a pair of spaced apart arms 76 terminating in a hinge 78. The lever 70 is provided with a hole 70*a* complimentary to a hole 78*a* disposed through the hinge 78, so that the lever 70 can be pivotally affixed to the hinge 78 by a pin 80 disposed through the holes 70*a* and 78*a*. The lever 70 includes a hole 82 for engaging the actuating rod 66, which links the lever 70 to the latching member 60.

Figure 7:
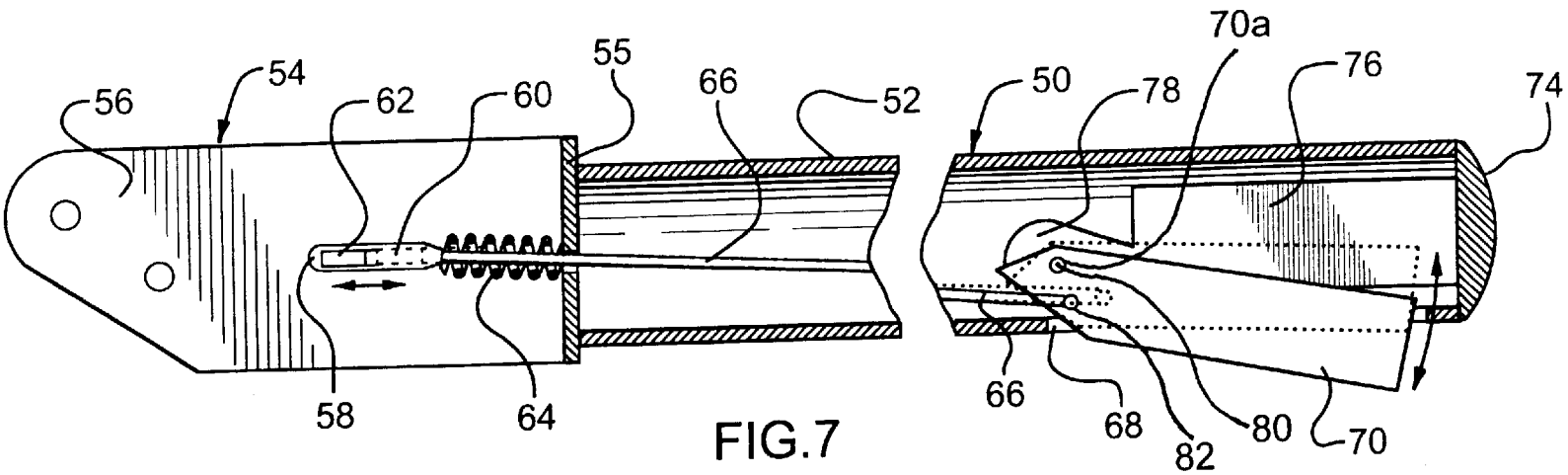
FIG. 7 is a cross-section of the handle showing the safety latch in the latching position.

Thus, the lever 70 is biased to the extended position by the biasing force of the compression spring 64 on the latching member 60, as shown in solid lines in FIG. 7, and depressing the lever 70 retracts the latching member 60 as shown in phantom lines in FIG. 7.

Figure 3:
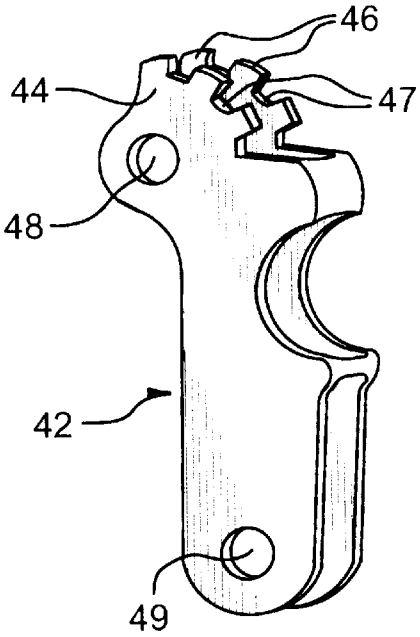
FIG. 3 is a perspective view of the safety link in the jack of FIG. 2.

A substantially rotationally fixed toothed element extends into the yoke 54 into which the latching member 60 engages. In the preferred embodiment the safety link 42, illustrated in FIG. 3, is provided with a toothed section 44 having a series of teeth 46. Preferably the teeth 46 are evenly spaced apart, the spacing between the teeth 46 being sufficient to allow the latching member 60 to engage between the teeth 46, and the toothed section 44 preferably extends about most of the radial span of the handle 50. The edges of the teeth 46 defining the spaces 47 between the teeth 46 are straight, so that the latching member 60 will firmly engage between the teeth 46 when in the latching position. As is conventional, holes 48 are provided for receiving the pin 28, to engage the safety link 40 to the handle 50 (between the arms 56 of the yoke 54), and holes 49 are provided for receiving the pin 30 to engage the safety link 42 to the lifting assembly 18.

In use, the jack 40 is positioned with the base plate 16 firmly on the ground or floor and the lifting leg 32 beneath the load. The operator depresses the lever 70, which pivots the lever 70 and causes the hole 82 to move toward the distal end of the handle, drawing the actuating rod 66 and thus retracting the latching member 60 from the toothed portion 44 of the safety link 42. The load can then be lifted in conventional fashion, by reciprocation of the handle 50 which lifts the load in increments as the lifting and lowering assemblies 18, 20 alternately creep up the vertical support 12 and lock into the apertures 14.

When the load is lowered, the operator depresses the lever 70, retracting the latching member 60 from the toothed portion 44 of the safety link 42 as described above, and the load can then be lowered in conventional fashion. If at any point the operator's hands slip off of the handle 50, or the operator otherwise releases the lever 70, the spring 64 forces the latching member 60 toward the toothed portion 44 of the safety link 42. The load causes the handle 50 to rise and the latching member 60 either latches into a space between the teeth 46, if the latching member 60 is in alignment with a space 47 when the lever 70 is released, or rides across the top of the tooth 46 with which the latching member 60 is in alignment when the lever 70 is released and engages into the next nearest space 47 in the direction of travel of the handle (counterclockwise in the embodiment shown). In either case the latching member quickly engages into the latching position shown in solid lines in FIG. 7, preventing the handle 50 from rising beyond a few inches.

The invention thus locks the handle 50 into a substantially fixed position relative to the support 12 unless the lever 70 is depressed to retract the latching member 60 from the toothed section 44 of the safety link 40. In addition to the safety feature described above, the invention provides a means for locking the handle 50 alongside the support 12 for compact storage.

A preferred embodiment of the invention having been thus described by way of example only, it will be apparent to those skilled in the art that certain modifications and adaptations may be made without departing from the scope of the invention, as set out in the appended claims.

What is claimed is:

1. A mechanical lifting jack having a vertical support provided with a series of apertures, an upper lifting assembly and a lower follower assembly having a lifting foot slidably mounted on the vertical support and engagable therewith at predetermined positions, an operating handle pivotally connected by a yoke to the lifting assembly for vertical movement, a safety link pivotally connected at an upper end to the handle and at a lower end to the lower follower assembly, and a reversing member pivotable between a lifting position for lifting a load by reciprocal movement of the handle causing upward movement alternately of the lifting and lowering assemblies and a lowering position for lowering the load by reciprocal movement of the handle causing downward movement alternately of the lifting and lowering assemblies, a latching member extending between opposed arms of the yoke, movable between a latching position and a retracted position and biased to the latching position, a lever projecting from the handle operatively connected to the latching member, to move the latching member between the latching position and the retracted position, and a rotationally fixed toothed element extending into a space between the arms of the yoke, whereby when the latching member is engaged into the toothed element the handle is prevented from substantial upward and downward movement and depression of the lever retracts the latching member from the toothed element and allows the handle to move through its normal operating motion.

2. The mechanical lifting jack of claim 1 wherein the latching member is provided with end wings trapped within slots formed in the arms of the yoke.

3. The mechanical lifting jack of claim 1 wherein the lever is operatively connected to the latching member by a rod extending through a base of the yoke.

4. The mechanical lifting jack of claim 3 wherein the latching member is biased toward the toothed element by a spring disposed between the base of the yoke and the latching member.

5. The mechanical lifting jack of claim 1 wherein the toothed element comprises teeth extending substantially about a radial span of the handle.

6. The mechanical lifting jack of claim 1 wherein the lever is pivotally fixed to the handle near a free end of the handle.

7. The mechanical lifting jack of claim 6 wherein the lever is pivotally fixed to a hinge portion of a handle insert disposed in the free end of the handle.

8. A safety latch for a mechanical lifting jack having a vertical support provided with a series of apertures, an upper lifting assembly and a lower follower assembly having a lifting foot slidably mounted on the vertical support and engagable therewith at predetermined positions, an operating handle pivotally connected by a yoke to the lifting assembly for vertical movement, a safety link pivotally connected at an upper end to the handle and at a lower end to the lower follower assembly, and a reversing member pivotable between a lifting position for lifting a load by reciprocal movement of the handle causing upward movement alternately of the lifting and lowering assemblies and a lowering position for lowering the load by reciprocal movement of the handle causing downward movement alternately of the lifting and lowering assemblies, the safety latch comprising a latching member extending between opposed arms of the yoke, movable between a latching position and a retracted position and biased to the latching position, a lever projecting from the handle operatively connected to the latching member, to move the latching member between the latching position and the retracted position, and a rotationally fixed toothed element extending into a space between the arms of the yoke, whereby when the latching member is engaged into the toothed element the handle is prevented from substantial upward and downward movement and depression of the lever retracts the latching member from the toothed element and allows the handle to move through its normal operating motion.

9. The safety latch of claim 8 wherein the latching member is provided with end wings trapped within slots formed in the arms of the yoke.

10. The safety latch of claim 8 wherein the lever is operatively connected to the latching member by a rod extending through a base of the yoke.

11. The safety latch of claim 10 wherein the latching member is biased toward the toothed element by a spring disposed between the base of the yoke and the latching member.

12. The safety latch of claim 8 wherein the toothed element comprises teeth extending substantially about a radial span of the handle.

13. The safety latch of claim 8 wherein the lever is pivotally fixed to the handle near a free end of the handle.

14. The mechanical lifting jack of claim 13 wherein the lever is pivotally fixed to a hinge portion of a handle insert disposed in the free end of the handle.

* * * * *